US009170591B2

(12) United States Patent
Pons

(10) Patent No.: US 9,170,591 B2
(45) Date of Patent: Oct. 27, 2015

(54) LOW DROP-OUT REGULATOR WITH A CURRENT CONTROL CIRCUIT

(71) Applicant: STMicroelectronics International N.V., Amsterdam (NL)

(72) Inventor: Alexandre Pons, Vizille (FR)

(73) Assignee: STMicroelectronics International N.V., Amsterdam (NL)

( * ) Notice: Subject to any disclaimer, the term of this patent is extended or adjusted under 35 U.S.C. 154(b) by 147 days.

(21) Appl. No.: 14/018,967

(22) Filed: Sep. 5, 2013

(65) Prior Publication Data

US 2015/0061621 A1 Mar. 5, 2015

(51) Int. Cl.
*G05F 1/571* (2006.01)
*G05F 1/56* (2006.01)

(52) U.S. Cl.
CPC ..... *G05F 1/56* (2013.01)

(58) Field of Classification Search
CPC .... H03L 2207/50; H03L 7/0991; G05F 1/563
USPC ..... 323/271–277, 282–288, 312–316; 361/89, 74, 94
See application file for complete search history.

(56) References Cited

U.S. PATENT DOCUMENTS 6,118,642 A * 9/2000 Benenati et al. ..... 361/89
6,388,433 B2 * 5/2002 Marty ..... 323/284
6,804,102 B2 * 10/2004 Hamon et al. ..... 361/93.3
7,315,153 B2 * 1/2008 Tazawa et al. ..... 323/272
7,714,553 B2 * 5/2010 Lou ..... 323/276
8,294,441 B2 * 10/2012 Gurcan et al. ..... 323/280
8,576,589 B2 * 11/2013 Melanson et al. ..... 363/49
2011/0248688 A1 10/2011 Iacob et al.
2011/0285456 A1 * 11/2011 Thornton et al. ..... 327/541
2012/0062198 A1 3/2012 Takano et al.
2013/0320942 A1 * 12/2013 Vemula ..... 323/274

FOREIGN PATENT DOCUMENTS

CN 102364407 A 2/2012
JP 2005198439 A 7/2005

* cited by examiner

*Primary Examiner* — Rajnikant Patel
(74) *Attorney, Agent, or Firm* — Seed IP Law Group PLLC

(57) ABSTRACT

A circuit including a low drop-out regulator (LDO) has a current control loop configured and connected to detect whether an external capacitor is connected to the output of the LDO. The current control loop includes a differential amplifier, a current source capable to output different reference currents and a small MOS transistor. The circuit may be operated in an output capacitor detection mode when started and in a regulated voltage source mode otherwise. In the output capacitor detection mode, the small MOS transistor is driven by the differential amplifier and drives the LDO's power MOS transistor depending on a difference between a current through the small MOS transistor and the reference current output by the current source. Components of the current control loop may be used during regulated voltage source mode for short circuit protection.

24 Claims, 8 Drawing Sheets

LOW DROP-OUT REGULATOR WITH A CURRENT CONTROL CIRCUIT

TECHNICAL FIELD

The present invention generally relates to devices and methods related to a circuit including a low drop-out regulator (LDO) and including a current control circuit enabling detection of whether an external capacitor is connected to the LDO's output.

BACKGROUND

LDOs are devices used to maintain a constant DC output voltage, designed to operate with a very small input-output voltage differential, and characterized by high-efficiency operation and low heat dissipation. ICs housing LDOs are used in many devices. For example, sources including such ICs can be found in wireless devices such as mobile terminals (e.g., cell phones, smartphones, etc.), digital media players (e.g., MP3s and MP4s), DVD players, portable PCs, tablets, etc.

As schematically illustrated in FIG. 1, the main components of an LDO 100 are (A) a power metal-oxide-semiconductor (MOS) transistor 110 connected between LDO input connector 120 (VIN) and LDO output connector 130 (VOUT), and (B) a differential amplifier (error amplifier) 140. Power MOS transistor 110 uses an electric field to control the shape and, hence, conductivity across the power MOS transistor's source and drain terminals. In other words, conductivity across the power MOS transistor is variable, depending on a signal applied on the power MOS transistor's gate terminal (hereinafter, the word "terminal" will be omitted for brevity).

One input 142 of differential amplifier 140 receives a feedback (i.e., a fraction thereof via feedback network G) from LDO output connector 130, and another input 144 of differential amplifier 140 receives a stable voltage reference (VOUT). Differential amplifier's output 146 is connected to power MOS transistor 110's gate to maintain constant output voltage (VOUT). If, for example, the output voltage (VOUT) rises too high relative to the reference voltage (VREF), the signal applied to power MOS transistor 110's gate changes to decrease conductivity, causing the output voltage (VOUT) to decrease.

LDOs may include a short circuit protection (SCP) arrangement that limits the current drawn from the LDO in case of accidental short circuit and avoids breakage of the chip. The SCP arrangement in FIG. 1 includes a small MOS transistor 150 having its source connected to LDO input connector 120 and its drain connected to a current mirror 155 (which is connected also to a current source 160), and to the ground (i.e., a fixed low voltage) via a resistor $R_{ref}$.

A current $I_{small}$ flowing through small MOS transistor 150 is proportional to the output current $I_{out}$:

$$I_{small}=a\cdot I_{out} \tag{1}$$

where a is a proportionality factor of about 1/1000.

The SCP arrangement further includes an SCP differential amplifier 170 that compares a potential difference V determined by the product of $R_{ref}$ with a difference between the current flowing through small MOS transistor 150 and a reference current, $I_{ref}$, supplied by current source 160 with a reference voltage VREF.

$$V=R_{ref}(a\cdot I_{out}-I_{ref}) \tag{2}$$

The SCP arrangement also includes a pull-up (Pup) MOS transistor 175 having its source connected to LDO input connector 120, its drain connected to small MOS transistor 150's gate, and its gate connected to the output of SCP differential amplifier 170. When a short circuit occurs at the output, output current $I_{out}$ increases suddenly, causing the current flowing through small MOS transistor 150 to become too high relative to $I_{ref}$. The SCP differential amplifier 170's output then decreases, causing Pup MOS transistor 175 to change voltage on power MOS transistor 110's gate, thereby preventing current from flowing there-through (i.e., closing power MOS transistor 110). Pup MOS transistor 175 is designed to have enough current capability to force (via small MOS transistor 150) power MOS transistor 110's gate to rise to VIN regardless the state of differential amplifier 140. Thus, small MOS transistor 150 and power MOS transistor 110 operate as a power sense structure. Typically, power MOS transistor 110, small MOS transistor 150 and Pup MOS transistor 175 are P-MOS transistors.

The SCP arrangement limits the LDO's output current $I_{out}$ to a value $I_{max}$:

$$I_{max}=\frac{1}{a}\cdot(I_{ref}+V_{ref}/R_{ref})=\frac{1}{a}I_{ref0}. \tag{3}$$

LDOs need an external output capacitor to be stable. Absence of the external output capacitor causes the LDO to oscillate, which is undesirable or even unacceptable. Although an IC with LDO may include a capless circuit enabling it to overcome the absence of the external output capacitor, presence of the external output capacitor must be determined to operate the LDO.

Conventionally, whether the external output capacitor is present is detected by independent circuitry, outside the IC housing the LDO. One conventional solution is to detect the presence of the external output capacitor by evaluating the discharge time of the external capacitor with an ADC. This solution requires (besides the ADC) a dedicated state machine to output an indication regarding the presence of the external output capacitor. The operation of the device including the IC housing the LDO must then have a dedicated detection timeslot during which the LDO cannot be used (its output voltage is 0). These constraints and additional equipment renders the conventional solution inefficient.

Accordingly, it is desirable to provide an IC housing an LDO which would efficiently incorporate external output capacitor detection while also providing short circuit protection.

SUMMARY

A circuit housing an LDO has a current control circuit enabling autonomous external capacity detection and short circuit protection. Some embodiments allow automatic configuration, automatic short circuit trimming and current limitation.

According to an exemplary embodiment, a circuit including a low drop-out regulator (LDO) has an LDO input connector to receive an input voltage (VIN), an LDO output connector to supply an output voltage (VOUT), a power MOS transistor and an LDO differential amplifier. The power MOS transistor has its source connected to the LDO input connector and its drain connected to the LDO output connector. The LDO differential amplifier is connected to drive the gate of the power MOS transistor, and to receive a feedback signal from the LDO output connector at a first input and a first reference voltage (VREF) at a second input. The circuit further includes a small MOS transistor having its source connected to the LDO input connector, and its gate thereof connected between the LDO differential amplifier and the gate of the power MOS transistor. The circuit also includes current source circuitry configured to provide a reference current, having an output connected to the drain of the small MOS transistor. The circuit further includes a current-control differential amplifier configured to compare a voltage at the output of the current source circuitry with a second reference voltage, the current-control differential amplifier having an AB type output stage connected between the LDO input connector and a fixed low voltage. The circuit also includes a switch connected between the LDO differential amplifier and the gate of the small MOS transistor, and a comparator configured to compare the output voltage rom the LDO output connector with a threshold voltage (b.ref). The circuit further includes a current controller configured to receive, an indication (CC_OK) from the comparator, and to output an output-capacitor signal (CAP_OK).

According to yet another embodiment, there is a method for using the circuit described above and additionally having the current controller configured to output a current control input signal, and the current source is configured to generate and output, as the reference current, a high reference current or a low reference current, which is smaller than the high reference current, depending on the current control input signal. The method includes operating the circuit in an output capacitor detection mode, and operating the circuit in a regulated voltage source mode. During the output capacitor detection mode, (i) initially, the switch is open, the current control input signal causes the current source to output the low reference current, the AB type output stage of the current-control differential amplifier drives the small MOS transistor, which then drives the power MOS transistor, determining an increase of the output voltage monitored by the comparator at a rate depending on the capacitor outside the LDO, and the current controller outputs the output-capacitor signal (CAP_OK) at a first value indicating presence of the capacitor outside the LDO if the output voltage (VOUT) reaches the predetermined threshold later than a predetermined time interval from a beginning of the output capacitor detection mode, and outputs the output-capacitor signal (CAP_OK) at a second value otherwise. During the regulated voltage source mode, the switch is closed and the current control input signal causes the current source to output the high reference current.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a circuit including an LDO.

Reference throughout the specification to "one embodiment" or "an embodiment" means that a particular feature, structure or characteristic described in connection with an embodiment is included in at least one embodiment of the present invention. Thus, the appearance of the phrases "in one embodiment" or "in an embodiment" in various places throughout the specification is not necessarily all referring to the same embodiment. Further, the particular features, structures or characteristics may be combined in any suitable manner in one or more embodiments.

Figure 1:
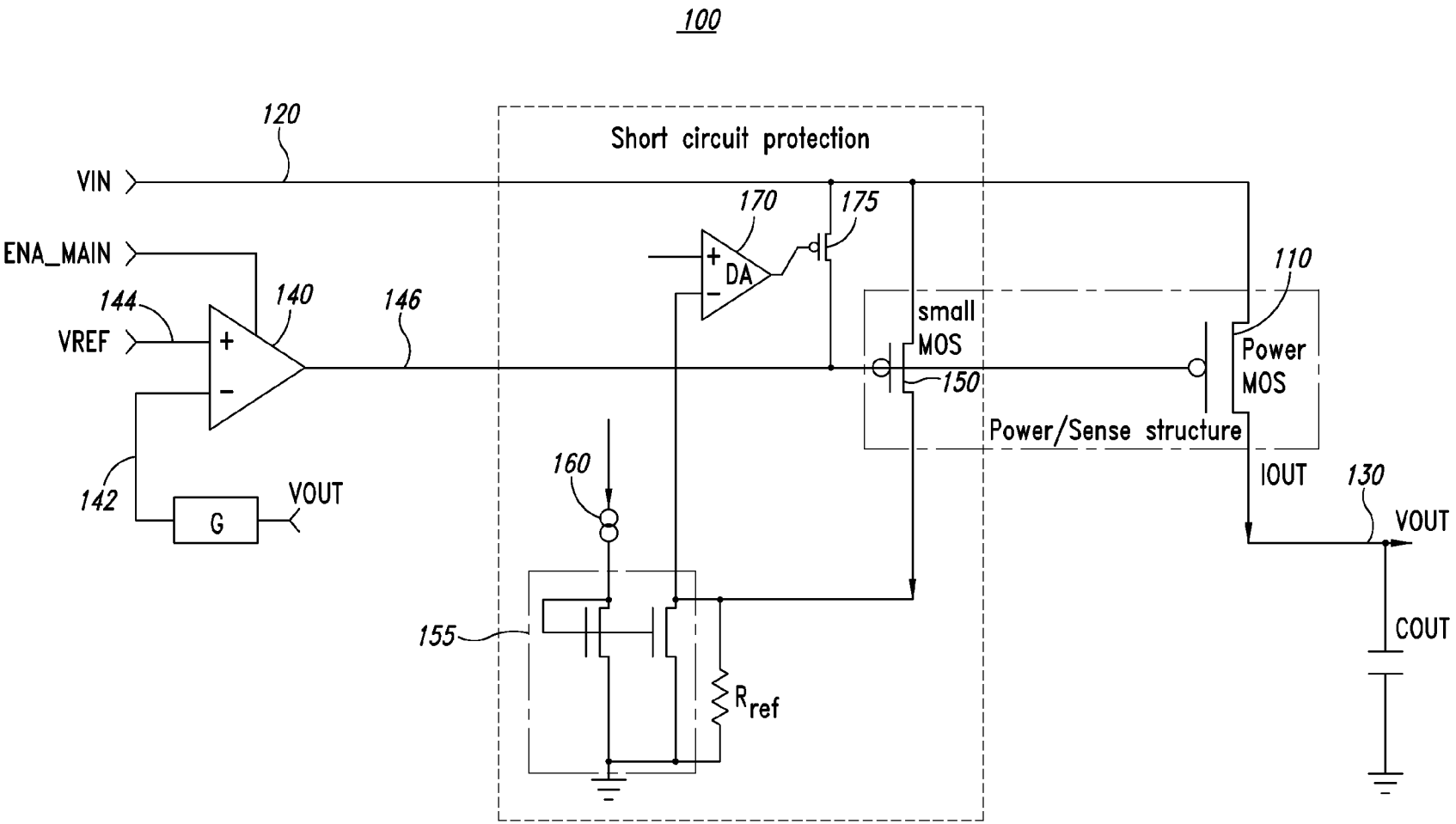
FIG. 1 (Prior Art)
FIG. 1 is a schematic diagram of a conventional IC housing an LDO with SCP.
Figure 2:
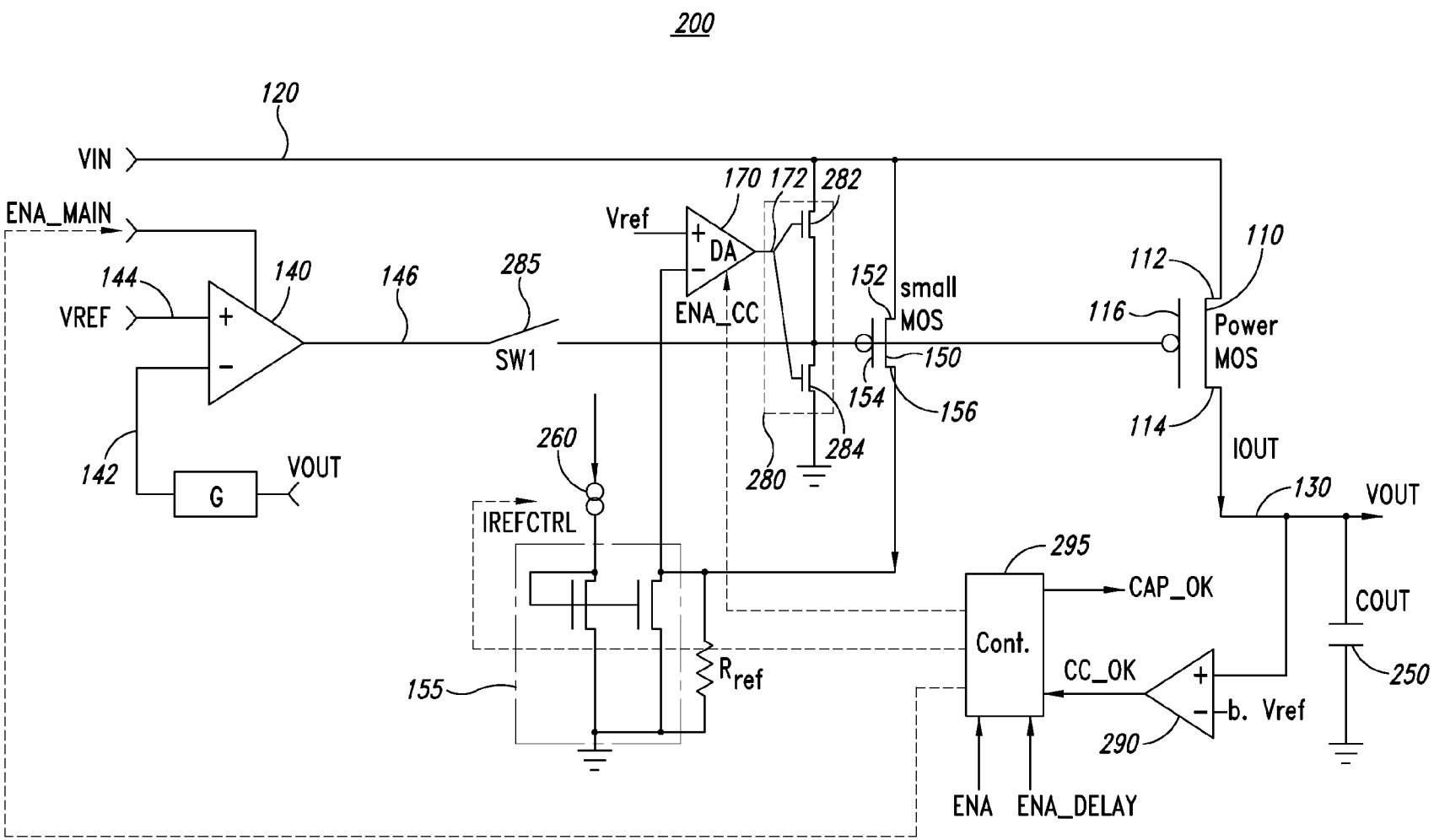
FIG. 2 is a schematic diagram of an IC housing an LDO according to an exemplary embodiment.

According to an exemplary embodiment illustrated in FIG. 2, a circuit 200 (which may be an integrated circuit, IC) housing an LDO includes a current control circuit using a power/sense structure in an SCP arrangement and configured to detect whether a capacitor COUT is connected to the output of the LDO, outside circuit 200. Encapsulating the components in an IC is a beneficial feature, but it should not be construed as a limitation. In other words, the electronic circuits 200, 500 and 600 may be connected and operate as described below, even if they are not part of an integrated circuit.

The LDO's main elements are a power MOS transistor 110 (which may be a P-MOS transistor) and a differential amplifier (error amplifier) 140. The power MOS transistor's source 112 is connected to LDO input connector 120 (VIN) and power MOS transistor's drain 114 is connected to LDO output connector 130 (VOUT). Conductivity across the power MOS transistor 110 (source to drain) is variable, depending on a signal output by the differential amplifier and applied to power MOS transistor's gate 116.

Differential amplifier 140 has one input 142 connected to receive a feedback from LDO output connector 130, another input 144 connected to a stable voltage reference (VREF), and its output 146 connected to power MOS transistor's 110 gate. Due to the voltage feedback loop, output voltage (VOUT) is maintained constant.

A short circuit protection (SCP) arrangement limits the output current $I_{out}$ below a value $I_{max}$. The SCP arrangement includes a small MOS transistor 150 (which may also be a P-MOS transistor) having its source 152 connected to LDO input connector 120 and its drain 156 connected to a current mirror 155 (which is connected also to a current source 260 configured to provide two different reference currents), to the ground (i.e., a fixed low voltage) via a resistor $R_{ref}$.

A current-control differential amplifier 170 that compares a voltage determined by a difference between the current flowing through small MOS transistor 150, $I_{small}$, and reference current, $I_{ref}$, supplied by current source 260 with a reference voltage VREF. Current source 260 may output two different currents, a high reference current or a low reference current (which is smaller than the high reference current) depending on a current control input signal, IREFCTRL. The output of current-control differential amplifier 170 is fed to an AB type output stage 280 connected between LDO input connector 120 and the ground to drive gate 154 of small MOS transistor 150. The AB type output stage 280 (which may include two MOS transistors, 282 and 284) is able to drive power MOS transistor's gate to any value between VIN and 0 (ground). MOS transistor 282 has its source connected to input connector 120 and its drain connected to the gate 154 of the small MOS transistor 150, and to the drain of MOS transistor 284. The source of MOS transistor 284 is connected to the ground.

A switch 285 is placed between the output of differential amplifier 140 and power MOS transistor 110 to optionally disconnect differential amplifier 140 from the voltage loop. Switch 285 may be toggled by a control signal which is a combination of ENA signal and CC_OK signal.

A comparator 290 is configured to monitor an output voltage (VOUT) from LDO output connector 130. Output of comparator 290 is supplied to a controller 295. Controller 295 is configured to supply current control input signal (IREFCTRL) to current source 260 and to output an output-capacitor indication, CAP_OK, as to whether a capacitor COUT is connected to LDO output connector 130 outside circuit 200. Thus, controller 295 output a first value of the output capacitor signal if the LDO output connector (120) is connected to ground via a capacitor (250) outside the ICLDO, and a second value otherwise. Controller 295 may also supply an enabling signal ENA_MAIN to differential amplifier 140, thereby being able to disable it when not is use.

Circuit 200 has a startup operation including a current control phase during which it is determined whether the capacitor COUT is present and connected, and a normal startup phase. Before the startup operation, the LDO is off, and after the startup operation the LDO is on, the circuit being in a controlled voltage (CV) phase. In other words, the circuit is configured to operate in an output capacitor detection mode (the current control phase), and a regulated voltage source mode (the normal startup phase and then the controlled voltage phase).

Figure 3:
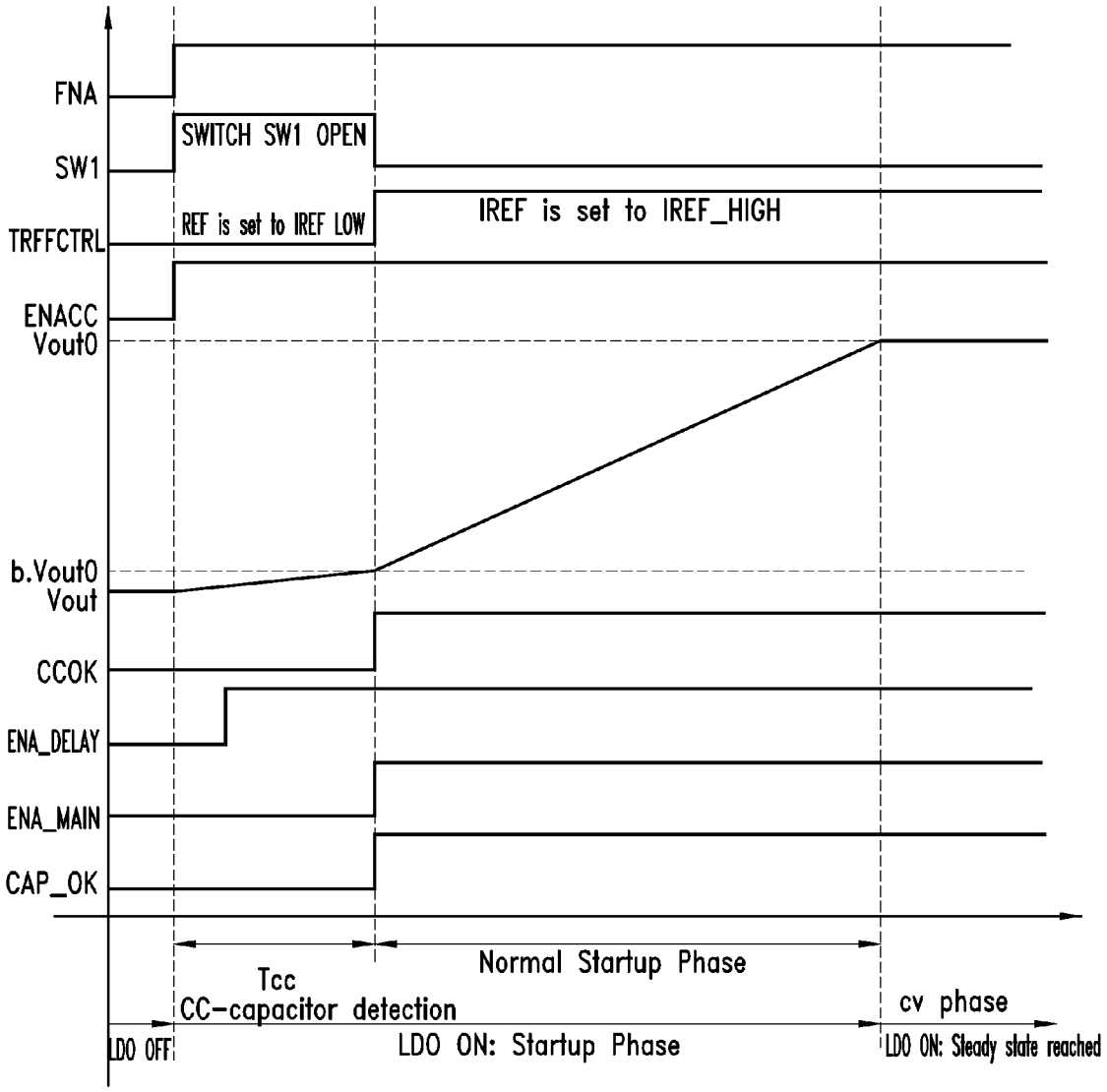
FIG. 3 is a sequence of graphs having a common horizontal time axis illustrating operation of an exemplary embodiment when a capacitor is present and connected to the LDO's output.
Figure 4:
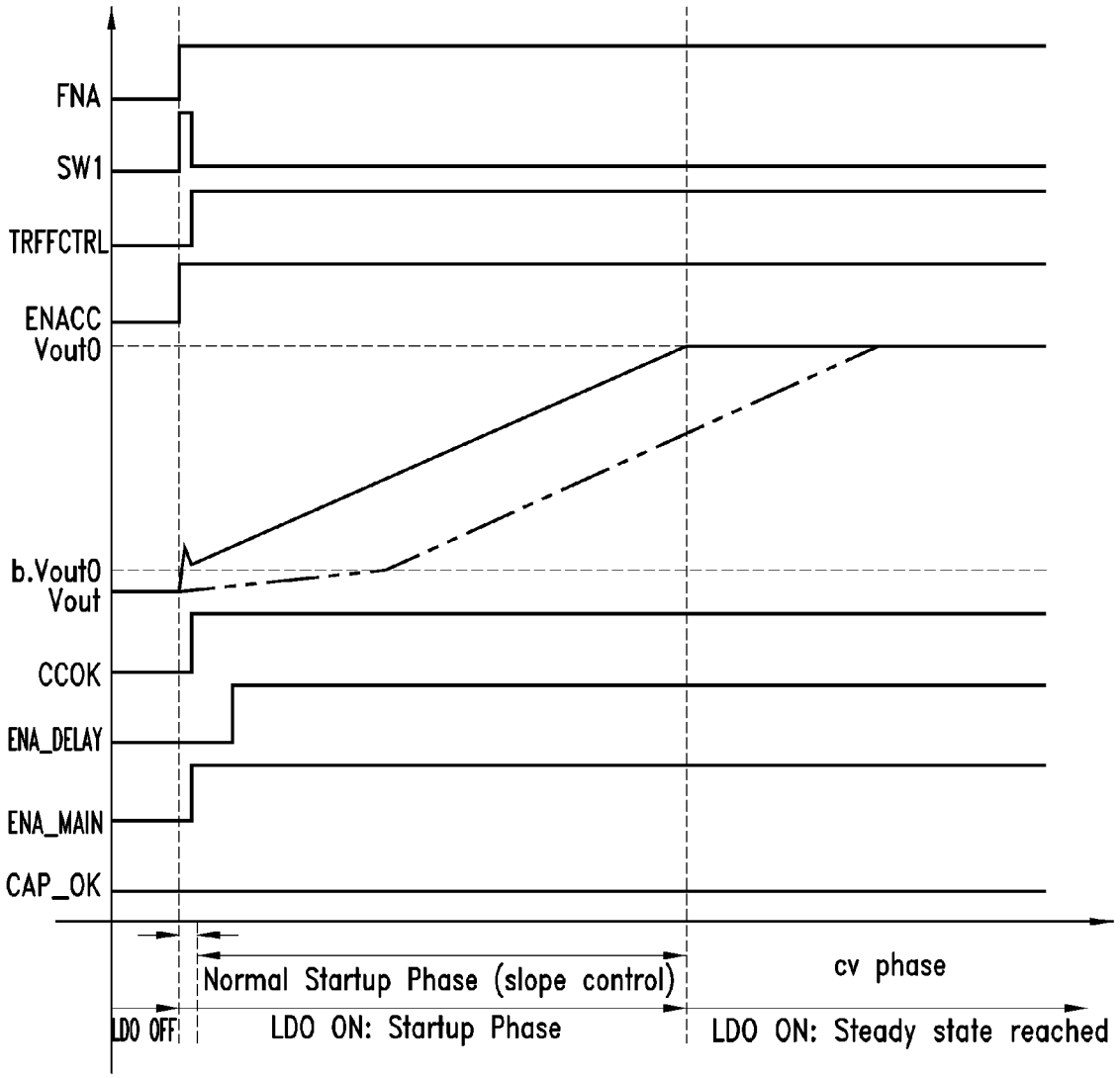
FIG. 4 is a sequence of graphs having a common horizontal time axis illustrating operation of an exemplary embodiment when a capacitor is not connected to the LDO's output.

FIGS. 3 and 4 are diagrams illustrating various signals during these phases. FIG. 3 corresponds to the situation in which the capacitor COUT is present and connected, while FIG. 4 corresponds to the situation in which the capacitor COUT is not present and connected. On the horizontal axis in FIGS. 3 and 4 is time in arbitrary units, and on the vertical axis are the different signals whose evolution is described and explained below. Note that all represented signals except VOUT are digital signals characterized by two values usually labeled with 0 and 1. Signals' functions are defined relative to state changes between the two values.

During the current control phase, a current control loop is used to detect whether the capacitor COUT is present and connected to LDO output connector 130. The LDO (i.e., voltage control) is OFF during this phase because switch 295 is open; the digital signal ENA_MAIN turn off the differential amplifier 140 so it would not be in an undetermined state (oscillating, at VIN or at ground potential) while its feedback path is open. The digital signal ENA_CC enables current control differential amplifier 170. In fact, this current control differential amplifier 170 is enabled as long as the circuit is powered, in order to accomplish the capacitor detector function during the current control phase and the short circuit protection function thereafter. Presence of ENA_CC is a feature, but not a limitation.

Further, during the current control phase, switch 285 is open. Signal IREFCTRL is set to a value determining current source 260 to output the low reference current. The AB type output stage 280 makes it possible for current-control differential amplifier to drive small MOS transistor 150 to deliver any predefined current:

$$I_{small}=I_{ref_low}+V_{ref}/R_{ref}=\alpha\cdot I_{ref0} \tag{4}$$

In other words, the power/sense structure is used in reverse mode, with small MOS transistor 150 imposing gate-source voltage to power MOS transistor 110. Power MOS transistor 110 now copies current through small MOS transistor 150 to output:

$$I_{out}=I_{small}/a=\alpha\cdot I_{max} \tag{5}$$

The output voltage, VOUT, which is monitored by comparator 290 being compared with $V_{ref}=b\cdot V_{out0}$ (where $V_{out0}$ is the LDO controlled operation voltage), rises with a rate $$\frac{dV_{OUT}}{dt}=\alpha\cdot I_{max}/C_{OUT}. \tag{6}$$

Parameter $\alpha$ is preferably in a range of 0.05 to 0.2. A faster rate of rising VOUT than the rates determined by these preferred $\alpha$ ranges may cause spikes to impair capacitor detection.

The output CC_OK of comparator 290 changes (e.g., from zero to 1) when VOUT becomes equal to $b\cdot V_{out0}$. Parameter b, which determines the comparator threshold, is preferably around 0.1 to have negligible impact on LDO startup time since the current control phase extends the startup time.

The time $T_{cc}$ needed for the output voltage to rise to this value is $$T_{CC}=\frac{C_{OUT}}{\alpha\cdot I_{max}}\cdot b\cdot V_{out0}. \tag{7}$$

If a capacitor COUT of about 1 μF is connected to LDO output connector 130 outside circuit 200, the time $T_{cc}$ is in a range of 10-50 μs. If a capacitor is not present and connected, parasitic capacities may cause a capacitor of a few nF and the time $T_{cc}$ is 1,000 times smaller (much less than 1 μs).

In order to determine whether $T_{cc}$ is larger than a few μs (i.e., the capacitor COUT is present and connected), a pair of digital signals, ENA and ENA_DELAY, may be used. Signal ENA is turned ON (i.e., 1) first, and after a few μs, signal ENA_DELAY is also turned ON so that: ENA_DELAY=ENA+x μs, where x may be between 1 and 5. If COUT is present, ENA_DELAY is ON when CC_OK changes and the digital output CAP_OK of controller 290 changes its state (e.g., becomes 1), indicating COUT present. If COUT is not present, ENA_DELAY=0 when CC_OK changes and the digital output CAP_OK of controller 290 maintains its state (e.g., 0), indicating COUT absent.

The current control phase lasts until VOUT becomes equal to $b\cdot V_{out0}$. Thus, by comparing VOUT as a function of time in FIGS. 3 and 4, VOUT becomes equal to $b\cdot V_{out0}$ much faster in FIG. 4 when COUT is absent, and thus the current control phase is far shorter in the absence of COUT.

After the current control phase, at the beginning of the normal startup phase signal ENA_MAIN enables differential amplifier 140, signal IREFCTRL is set to a value determining current source 260 to output the high reference current, and switch 285 is closed. The output voltage ramps up to the nominal operation value $V_{out0}$.

Parameter $\alpha$ is preferably in a range of 0.05 to 0.2 so that $I_{ref}$ is lower than $I_{ref0}$ during the current control phase. A faster rate of rising VOUT than the rates determined by these preferred $\alpha$ values may cause spikes impairing capacitor detection.

In steady LDO operation phase, switch 185 is closed and $I_{ref}$, supplied by current source 260, is the high reference current. Therefore, the current control loop is disabled and differential amplifier 170 operates to limit the current to $I_{max}$ in a manner similar to the one previously described in this document.

Figure 5:
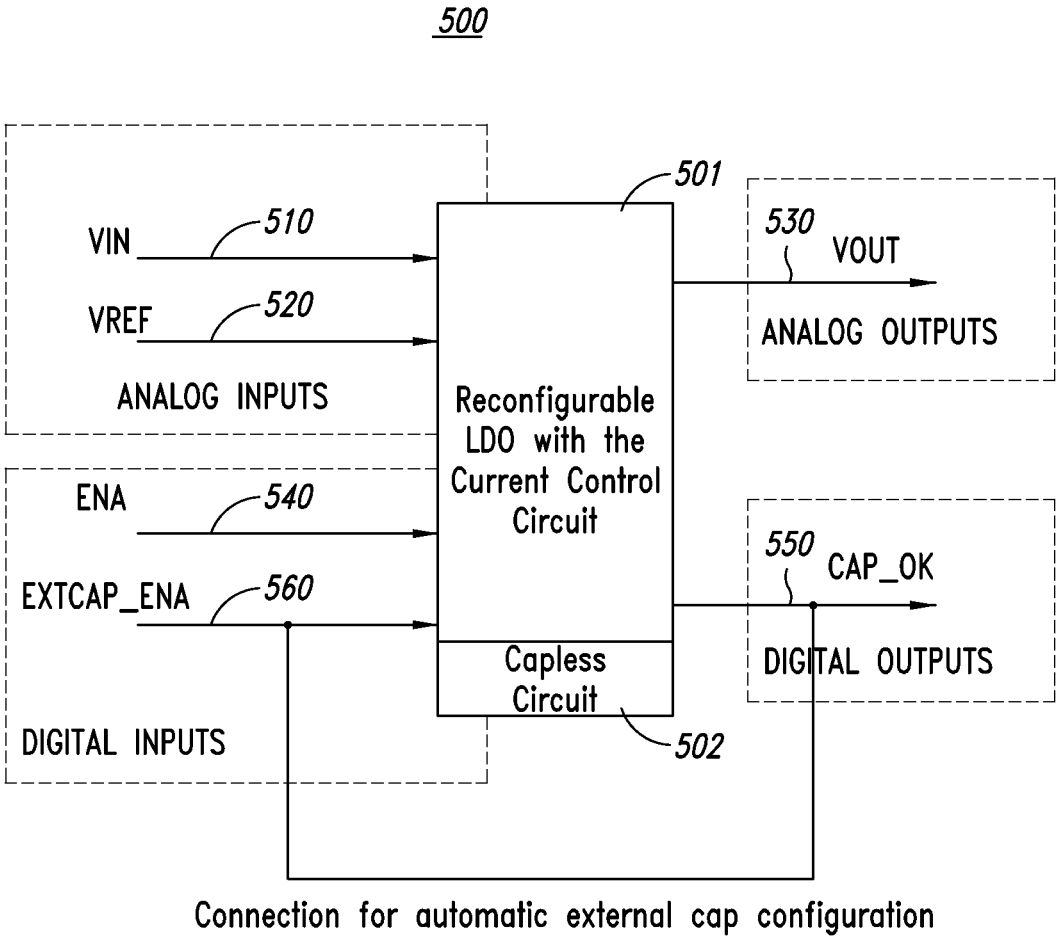
FIG. 5 is a schematic diagram of an IC including an LDO with current control, according to another exemplary embodiment.

In one embodiment, the circuit with LDO and a capless circuit (that would make it overcome the absence of the external output capacitor), may use the current control loop for automatic configuration. FIG. 5 illustrates an IC 500 including an LDO with current control 501 and a capless circuit 502. IC 500 has two analog input terminals: a first analog input terminal 510 (connected to LDO input connector 120) and a second analog input terminal 520 (providing reference voltage VOUT) and an analog output terminal 530 (connected to LDO output connector 130).

IC 500 has two digital input terminals: a first digital input terminal 540, ENA (a master enabling signal that is a feature of integrated circuits but should not be construed as a limitation) and a second digital inout terminal 560, EXTCAP_ENA that triggers use of capless circuit 502. IC 500 has also a digital output terminal 550, CAP_OK, receiving the CAP_OK signal indicating (based on detection) whether or not any external capacitor is present. Conventionally, selection of the appropriate configuration (with or without external capacitor) is performed depending on an external signal received at digital input terminal 560. Supplying an external signal may be inconvenient. The current control may be used for automatic configuration by connecting digital output terminal 550, CAP_OK, to digital input terminal 560, EXTCAP_ENA. This functionality is not feasible with conventional capacitor detection.

Figure 6:
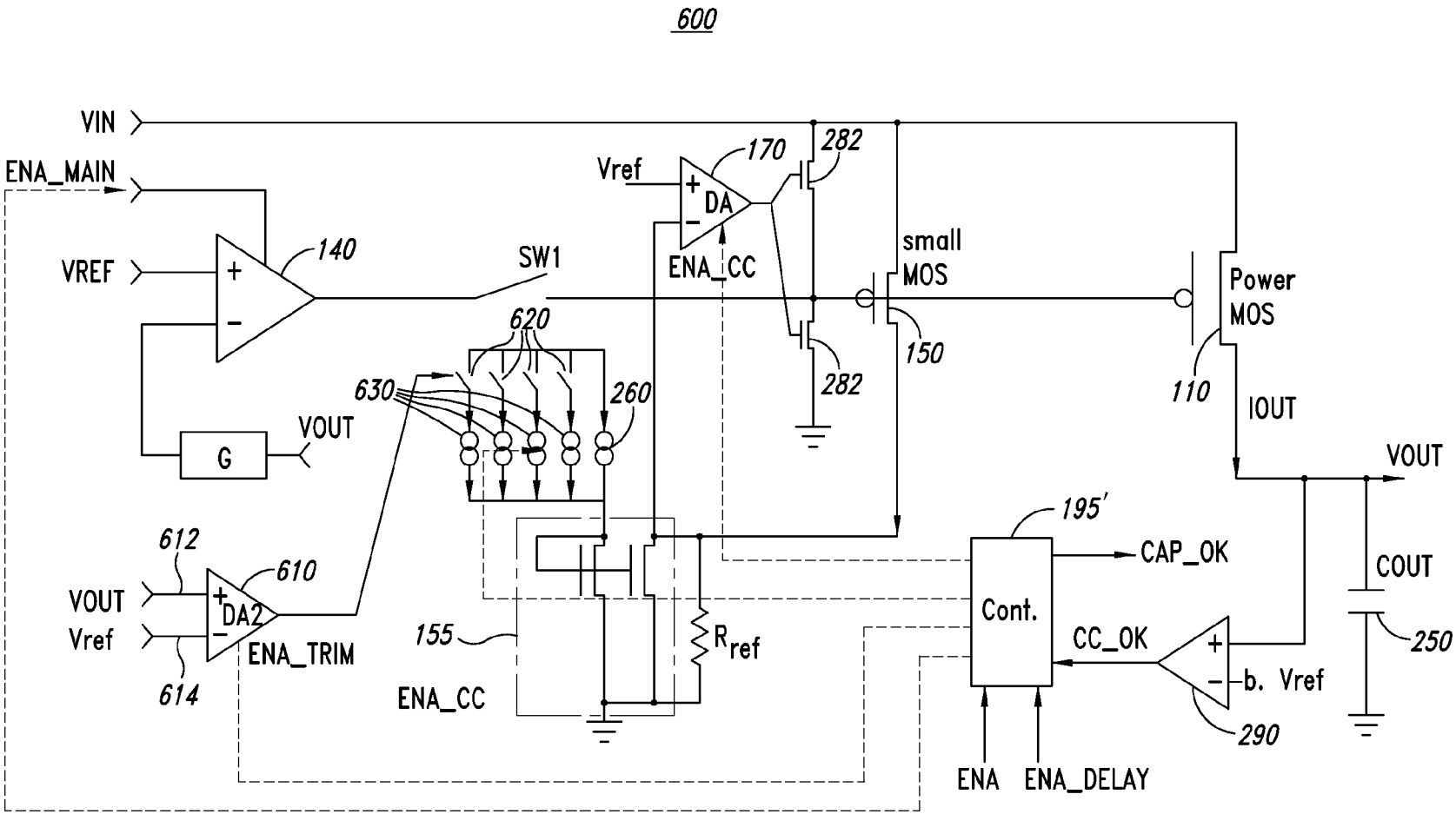
FIG. 6 is a schematic diagram of an IC including an LDO with current control, according to another exemplary embodiment.

In one embodiment illustrated in FIG. 6, current control may also be used for automatic short circuit protection trimming. IC 600 includes the components of IC 200 and further has an additional current-trimming loop usable during steady LDO operation. During steady LDO operation, IC 600 delivers a fixed current:

$$I_{out}=I_{small}/a=\alpha\cdot I_{max} \tag{8}$$

The additional loop is configured to modulate current $I_{ref}$:

$$I_{ref}=\alpha(I_{ref0}+n\cdot I_{ref0}/d) \tag{9}$$

where $I_{ref}/d$ is the adjustment step (for example, d=10 for a 10% trimming step).

Initially, the output load may be set to $R_{load}=V_{out0}/I_{max}$. A differential amplifier 610 that may be temporarily enabled by controller 195' via an ENA_TRIM changes the high reference current by closing one of switches 620 at a time, thereby adding one of a plurality of current sources 630 parallel to current source 260. Differential amplifier 610 receives VOUT at one input 612 and VREF at the other input 614. The current sources 630 are preferably identical with current source 260 such that n sources are connected to obtain $V_{OUT}=V_{out0}$. The current injected into the current mirror 155 is then $V_{out0}/R_{load}=I_{max}$. The n value can then be stored, the SCP being trimmed until the next trimming phase is activated by enabling differential amplifier 610.

The above-described embodiments are flexible because one IC may have several of the above-described functionalities, and autonomous since no additional external capacitor detection is necessary. External capacitor detection is automatic and reliable, being performed during startup of the IC and allowing detection of malfunctioning configurations (damaged external capacitor or soldering problems) during manufacturing, as well as during the lifetime of the device incorporating this IC. Capacitor detection has no impact on LDO operation, since no reserved timeslot is required and the LDO is always available. The current control loop is usable to automatically configure AnyCap LDOs (i.e., when a capless circuit is present).

Figure 7:
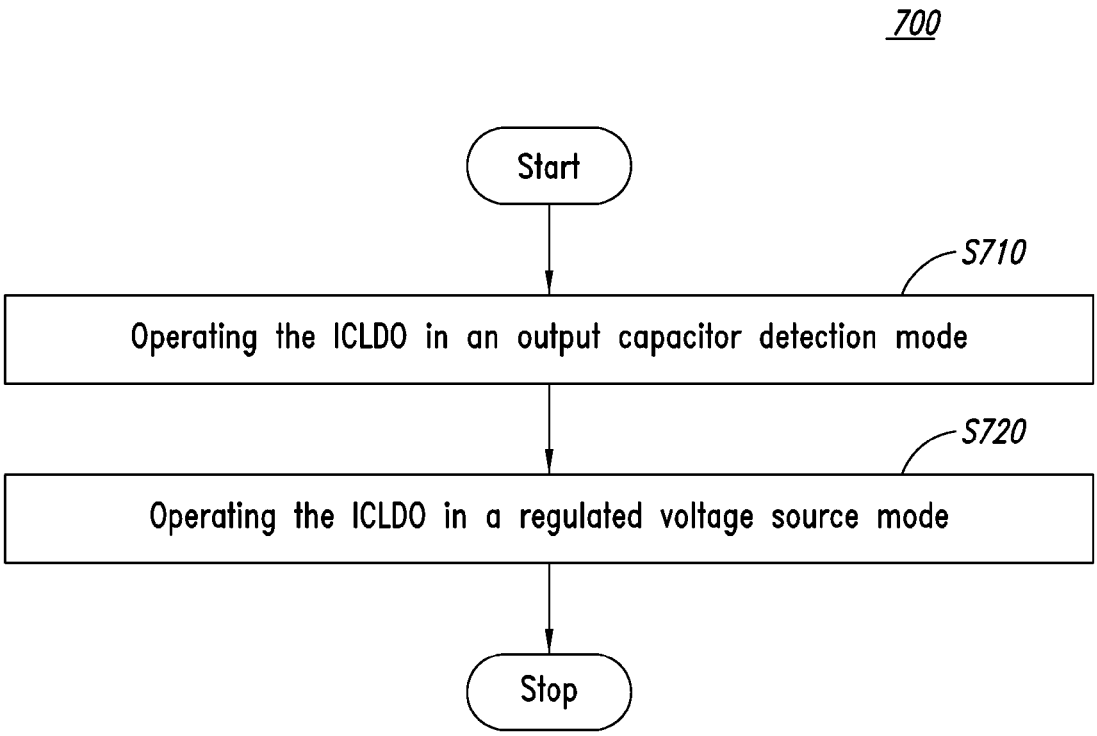
FIG. 7 is a flowchart of a method for using an LDO according to another exemplary embodiment.

FIG. 7 illustrates a flowchart of a method 700 for an ICLDO according to any of the above described embodiments. Method 700 includes operating the ICLDO in an output capacitor detection mode, and operating the ICLDO in a regulated voltage source mode. During the output capacitor detection mode (i) initially, the switch is open, and the current control input signal (IREFCTRL) causes the current source to output the low reference current, (ii) the AB type output stage of the current-control differential amplifier drives the small MOS transistor, which then drives the power MOS transistor, determining an increase of the output voltage (VOUT) monitored by the comparator at a rate depending on the capacitor outside the LDO, and (iii) the current controller outputs the output-capacitor signal (CAP_OK) at a first value indicating presence of the capacitor outside the LDO if the output voltage (VOUT) reaches the predetermined threshold later than a predetermined time interval from the beginning of the output capacitor detection mode, and outputs a second value otherwise.

During regulated voltage source mode, the switch is closed and the current control input signal (IREFCTRL) causes the current source to output the high reference current. The ICLDO may be operated in output capacitor detection mode when started up, and the output capacitor signal indicating presence of the capacitor outside the LDO may then cause the LDO to transition to operating in regulated voltage source mode.

In one embodiment of the method, operating the ICLDO in the output capacitor detection mode includes receiving, by the current controller a first enable signal, ENA, and a second enable signal, ENA_DELAY, and providing, by the current controller, a main enable signal (ENA_MAIN) to the LDO differential amplifier. Signal ENA enables the current controller to output the current control input signal, IREFCTRL, to cause the current source to output the low reference current. Signal ENA_DELAY is delayed relative to the ENA signal by the predetermined time interval. Signal ENA_MAIN causes the LDO differential amplifier to be disconnected during output capacitor detection mode. Also, operating the ICLDO in the regulated voltage source mode includes providing, by the current controller the main enable signal to the LDO differential amplifier, such that to reconnect the LDO differential amplifier.

Further, according to yet another embodiment, while operating the ICLDO of claim 3 in the output capacitor detection mode, the AB type output stage may drive the gate (116) of the power MOS transistor (110) to a value between a voltage applied to the LDO input connector (120) and ground.

In yet another embodiment, the integrated circuit may further include a capless circuit configured to enable the power MOS transistor to operate when the capacitor outside the LDO is absent. The method then further includes connecting the capless circuit or not depending on the output-capacitor signal (CAP_OK).

In one embodiment, the small MOS transistor, the current source, and the current-control differential amplifier may be configured to provide short circuit protection to the LDO. The LDO may further include one or more additional current sources connected via one or more additional switches parallel to the current source, and an additional differential amplifier. The additional differential amplifier is configured and connected to receive the output voltage (VOUT) at a first input and a third reference voltage at a second input, and to output a signal controlling whether the one or more additional switches connect the one or more additional current sources to the current source. The additional differential amplifier may also receive an enable signal (ENA_TRIM) from the current controller. The method then further includes adjusting a short circuit protection current by operating the additional differential amplifier to connect or disconnect at least one of the one or more additional sources depending on the enable signal (ENA_TRIM).

Figure 8:
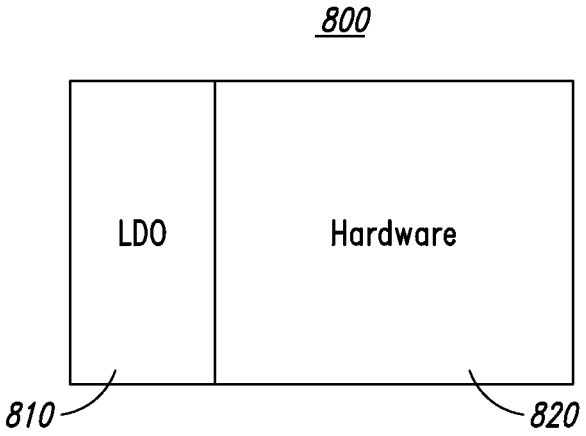
FIG. 8 is a schematic diagram of a device including an LDO with a current control loop according to another exemplary embodiment.

FIG. 8 illustrates a device 800 including an LDO 810 with a current control loop. The LDO 810 may be any of the above-described LDOs (e.g., 200, 500, 600 and their variants) and supplies power to hardware 820 performing various applications depending on the device's intended functionality (e.g., as mobile terminals, digital media players, DVD players, portable PCs, tablets, etc.).

The disclosed exemplary embodiments provide devices and methods for connecting one or more modular low-power units parallel to an LDO regulator to efficiently provide a high-power mode and a low-power mode. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

What is claimed is:

1. A low drop-out regulator (LDO) circuit, comprising:

an LDO input connector to receive an input voltage;

an LDO output connector to supply an output voltage;

a power MOS transistor having a source connected to the LDO input connector and a drain connected to the LDO output connector;

an LDO differential amplifier connected to drive a gate of the power MOS transistor, and to receive a feedback signal from the LDO output connector at a first input and a first reference voltage at a second input;

a small MOS transistor having a source connected to the LDO input connector, a gate connected between the LDO differential amplifier and the gate of the power MOS transistor;

current source circuitry configured to provide a reference current, having an output connected to a drain of the small MOS transistor;

a current-control differential amplifier configured to compare a voltage at the output of the current source circuitry with a second reference voltage, the current-control differential amplifier having an AB type output stage connected between the LDO input connector and a fixed low voltage;

a switch connected between the LDO differential amplifier and the gate of the small MOS transistor;

a comparator configured to compare the output voltage from the LDO output connector with a threshold voltage; and a current controller configured to receive an indication from the comparator and output an output-capacitor signal.

2. The circuit of claim 1, wherein the current controller is configured to output a first value of the output capacitor signal if the LDO output connector is connected to ground via a capacitor outside the circuit, and to output a second value otherwise.

3. The circuit of claim 1, wherein:

the current controller is configured to output a current control input signal; and the current source circuitry is configured to provide, as the reference current, a high reference current or a low reference current, which is smaller than the high reference current, depending on the current control input signal.

4. The circuit of claim 1, wherein the current controller is further configured:

to receive a first enable signal enabling the current controller to output the current control input signal causing the current source to output the low reference current, and a second enable signal which is delayed by a time interval relative to the first enable signal, and to provide a main enable signal to the LDO differential amplifier.

5. The circuit of claim 1, wherein:

the current source circuitry comprises a current source and a current mirror connected between the current source and the current-control differential amplifier.

6. The circuit of claim 1, wherein the AB type output stage includes two MOS transistors and is configured and connected to drive the gate of the power MOS transistor to a value between the input voltage and the fixed low voltage.

7. The circuit of claim 1, wherein the power MOS transistor, the LDO differential amplifier, the small MOS transistor, the current source circuitry, the current-control differential amplifier, the AB type output stage, the switch, the comparator and the current controller and interconnections therebetween are formed as an integrated circuit, ICLDO, having an analog LDO voltage input terminal connected to the LDO input connector, an analog reference voltage terminal and an analog regulated voltage output terminal connected to the LDO output connector.

8. The circuit of claim 7, further including:

a capless circuit configured to enable the power MOS transistor to operate when there is no external capacitor connected to the ICLDO, a digital output terminal configured to output the output-capacitor signal, and a digital input terminal configured to receive a digital enable signal, wherein the capless circuit is configured to be enabled by the digital enable signal.

9. The circuit of claim 8, wherein the digital output terminal is connected to the digital input terminal.

10. The circuit of claim 1, wherein the small MOS transistor, the current source circuitry, and the current-control differential amplifier are configured to provide short circuit protection to the LDO, the current source circuitry includes a first current source, and the circuit further comprises:

a second current source configured to be connected parallel to the first current source;

an additional switch connected in series with the second current source; and an additional differential amplifier having a first input connected to receive the output voltage, a second input connected to receive a third reference voltage, and an output, the additional differential amplifier being configured to control whether the second switch connects the the current source in parallel with the first current source, wherein the additional differential amplifier is configured to receive an enable signal from the current controller.

11. A method for using a circuit including a low drop-out regulator, LDO, an LDO input connector to receive an input voltage, an LDO output connector to supply an output voltage, a power MOS transistor having a source connected to the LDO input connector and a drain connected to the LDO output connector, an LDO differential amplifier connected to drive a gate of the power MOS transistor, and to receive a feedback signal from the LDO output connector at a first input and a first reference voltage at a second input, a small MOS transistor having a source connected to the LDO input connector, a gate connected between the LDO differential amplifier and the gate of the power MOS transistor, current source circuitry configured to provide a reference current, having an output connected to a drain of the small MOS transistor, a current-control differential amplifier configured to compare a voltage at the output of the current source circuitry with a second reference voltage, the current-control differential amplifier having an AB type output stage connected between the LDO input connector and a fixed low voltage, a switch connected between the LDO differential amplifier and the gate of the small MOS transistor, a comparator configured to compare the output voltage from the LDO output connector with a threshold voltage, and a current controller configured to receive, an indication from the comparator, and to output an output-capacitor signal and a current control input signal, wherein the current source is configured to generate and output, as the reference current, a high reference current or a low reference current, which is smaller than the high reference current, depending on the current control input signal, the method comprising:

operating the circuit in an output capacitor detection mode in which:

(i) initially, the switch is open, the current control input signal causes the current source to output the low reference current, (ii) the AB type output stage of the current-control differential amplifier drives the small MOS transistor, which then drives the power MOS transistor, causing an increase of the output voltage monitored by the comparator at a rate depending on whether there is an external capacitor connected to the LDO, and (iii) the current controller outputs the output-capacitor signal at a first value indicating presence of the external capacitor if the output voltage reaches the threshold voltage later than a selected time interval from a beginning of the output capacitor detection mode, and outputs the output-capacitor signal at a second value otherwise; and operating the circuit in a regulated voltage source mode, during which the switch is closed and the current control input signal causes the current source to output the high reference current.

12. The method of claim 11, wherein operating the circuit in the output capacitor detection mode occurs during a start-up phase of the circuit, and the output capacitor signal indicating presence of the external capacitor causes the circuit to transition to operating in the regulated voltage source mode.

13. The method of claim 11, wherein:

operating the circuit in the output capacitor detection mode includes:

receiving, by the current controller:

a first enable signal enabling the current controller to output the current control input signal so that to cause the current source circuitry to output the low reference current, and a second enable signal which is delayed relative to the first enable signal by the predetermined time interval, and providing, by the current controller, a main enable signal at a first value that disables the LDO differential amplifier during the output capacitor detection mode, and operating the circuit in the regulated voltage source mode includes providing, by the current controller the main enable signal at a second value that enables the LDO differential amplifier.

14. The method of claim 11, wherein, while operating the circuit in the output capacitor detection mode, the AB type output stage drives the gate of the power MOS transistor to a value between a voltage applied to the LDO input connector and the low reference voltage.

15. The method of claim 11, wherein the circuit further includes:

a capless circuit configured to enable the power MOS transistor to operate when there is no external capacitor connected to the LDO, and the method further includes:

connecting the capless circuit or not depending on the output-capacitor signal.

16. The method of claim 11, wherein the small MOS transistor, the current source circuitry, and the current-control differential amplifier are configured to provide short circuit protection to the LDO, the current source circuitry includes a first current source, and the circuit further comprises a second current source, an additional switch coupled to the current source circuitry, and an additional differential amplifier configured and connected to receive the output voltage at a first input and a third reference voltage at a second input and to output a signal controlling whether the one or more additional switches connect the second current source to the current source circuitry, and the method further comprises:

adjusting a short circuit protection current by operating the additional differential amplifier to connect or disconnect second current source in parallel with the first current source depending on an enable signal received by the additional differential amplifier from the current controller.

17. The circuit of claim 1, wherein the switch is configured to selectively electrically couple the output of the LDO differential amplifier to the gates of the MOS transistors.

18. The circuit of claim 1, wherein the current controller is configured to detect, based on the output from the comparator, whether an external capacitor is connected to the circuit.

19. A low drop-out regulator (LDO) circuit, comprising:

an LDO input connector to receive an input voltage;

an LDO output connector to supply an output voltage;

a power MOS transistor having a source connected to the LDO input connector and a drain connected to the LDO output connector;

an LDO differential amplifier connected to drive a gate of the power MOS transistor, and to receive a feedback signal from the LDO output connector at a first input and a first reference voltage at a second input;

a small MOS transistor having a source connected to the LDO input connector, a gate connected between the LDO differential amplifier and the gate of the power MOS transistor;

current source circuitry configured to provide a reference current, having an output connected to a drain of the small MOS transistor; and a current-control differential amplifier configured to compare a voltage at the output of the current source circuitry with a second reference voltage, the current-control differential amplifier having an AB type output stage connected between the LDO input connector and a fixed low voltage.

20. The circuit of claim 19, comprising a switch configured to selectively electrically couple the output of the LDO differential amplifier to the gates of the MOS transistors.

21. The circuit of claim 19, comprising:

a comparator configured to compare the output voltage from the LDO output connector with a threshold voltage; and a current controller is configured to detect, based on the output from the comparator, whether an external capacitor is connected to the circuit.

22. The circuit of claim 21, wherein the current controller is further configured:

to receive a first enable signal enabling the current controller to output the current control input signal causing the current source to output the low reference current, and a second enable signal which is delayed by a time interval relative to the first enable signal, and to provide a main enable signal to the LDO differential amplifier.

23. The circuit of claim 19, wherein:

the current source circuitry comprises a current source and a current mirror connected between the current source and the current-control differential amplifier.

24. The circuit of claim 19, wherein the AB type output stage includes two MOS transistors and is configured and connected to drive the gate of the power MOS transistor to a value between the input voltage and the fixed low voltage.

* * * * *